US006070030A

United States Patent [19]

Fujishiro

[11] Patent Number: 6,070,030

[45] Date of Patent: May 30, 2000

[54] IMAGE FORMING CARTRIDGE FOR AN IMAGE FORMING APPARATUS

[75] Inventor: Takatsugu Fujishiro, Tokyo, Japan

[73] Assignee: Ricoh Company, Ltd., Tokyo, Japan

[21] Appl. No.: 09/336,694

[22] Filed: Jun. 21, 1999

[30] Foreign Application Priority Data

Jun. 19, 1998 [JP] Japan ..... 10-172349

[51] Int. Cl.[7] ..... G03G 21/16; G03G 15/00

[52] U.S. Cl. ..... 399/111; 399/110; 399/167

[58] Field of Search ..... 399/110, 167, 399/111, 107, 116, 119, 117

[56] References Cited

U.S. PATENT DOCUMENTS

| | | | |
|---|---|---|---|
| 4,432,632 | 2/1984 | Yokota | 399/119 X |
| 5,053,817 | 10/1991 | Ogiri et al. | 399/167 |
| 5,132,728 | 7/1992 | Suzaki et al. | 399/167 |
| 5,319,418 | 6/1994 | Fujimoto et al. | 399/167 |
| 5,331,373 | 7/1994 | Nomura et al. | 399/111 |
| 5,444,516 | 8/1995 | Michlin et al. | 399/117 X |
| 5,512,976 | 4/1996 | Kamano | 399/116 |
| 5,570,160 | 10/1996 | Miwa et al. | 399/116 |
| 5,640,650 | 6/1997 | Watanabe et al. | 399/117 |
| 5,669,046 | 9/1997 | Yoshida et al. | 399/167 |
| 5,758,243 | 5/1998 | Haneda et al. | 399/111 X |
| 5,933,696 | 8/1999 | Howard et al. | 399/117 X |

*Primary Examiner*—Susan S. Y. Lee

*Attorney, Agent, or Firm*—Oblon, Spivak, McClelland, Maier & Neustadt, P.C.

[57] ABSTRACT

An image forming cartridge removably mounted on an image forming apparatus includes an image carrier for electrostatically forming a latent image thereon by electrophotography. A plurality of image forming members execute image formation with the image carrier. A casing accommodates the image carrier and image forming members. The image carrier has at least one axial end thereof supported such that it does not interfere with the casing. When the cartridge is mounted to the body of the image forming apparatus, a support portion for the image carrier and the casing are mounted to the body independently of each other.

11 Claims, 4 Drawing Sheets

IMAGE FORMING CARTRIDGE FOR AN IMAGE FORMING APPARATUS

BACKGROUND OF THE INVENTION

The present invention relates to an electrophotographic image forming apparatus and more particularly to a structure for supporting, when a photoconductive element or image carrier and other image forming members are arranged in a cartridge removable from the body of an image forming apparatus, supporting the photoconductive element.

Conventional printers, copiers, facsimile apparatus or similar electrophotographic image forming apparatuses include one operable with a removable image forming cartridge. The image forming cartridge accommodates a photoconductive element or image carrier and various image forming members arranged around the photoconductive element and including a charger, a developing unit and a cleaning unit. The cartridge is removably mounted on the apparatus body. This kind of scheme is taught in, e.g., Japanese Patent Laid-Open Publication No. 5-134482 and extensively used to promote easy maintenance and accurate positioning between the members.

Assume that the photoconductive element of the above cartridge is implemented by a photoconductive drum. Then, a shaft included in the drum is passed through holes formed in the side walls of the cartridge. Subsequently, positioning members are brought into contact with the shaft in order to position the axis of rotation of the drum.

Today, there is an increasing demand for an image forming apparatus capable of producing high quality images. One of current major attempts is to reduce irregularity in the pitch of a low density image, or so-called banding, ascribable to unstable drive of the apparatus. Specifically, because a low density image is formed by a smaller total amount of toner than a high density image, the above irregularity renders the difference between portions with toner and portions without toner conspicuous. Reducing banding as far as possible is therefore particularly important when it comes to a low density image.

Although the conventional cartridge configuration promotes easy maintenance, it fails to reduce banding to a sufficient degree. Specifically, when use is made of the cartridge, a drive source for driving the drum and other image forming members of the cartridge is mounted on the apparatus body and therefore needs a drive transmission mechanism to the cartridge. Two different systems are available for the drive transmission from the drive source to the cartridge. In a first system, a drive force is transmitted from the drive source to the drum and to the other members arranged in the cartridge via the drum. In a second system, the drive source is transmitted to each of the drum and other members via a particular path.

Generally, the above first system includes a gear or drive transmitting means mounted on one axial end of the shaft of the drum and held in mesh with gears mounted on the other members to be driven. This system is, however, not feasible for the image forming devices to be driven via the drum, particularly the developing unit. A heavy loads acts on the developing unit because not only a toner supply section but also an agitating member for charging toner are driven. As a result, the drive load is apt to vary between the gear of the developing unit and that of the drum, rendering the rotation of the drum irregular. As for a low density image, the drum makes the density of a portion where it has rotated at a high speed lower than desired density and makes the density of a portion where it has rotated at a low speed higher than the desired density. As a result, the density pitch becomes irregular due to the irregular rotation.

The second system obviates the drive transmission paths extending to the heavy load sections by way of the drum. However, the problem with the second system is that drive loads vary on the drive transmission paths between the apparatus body and the image forming members other than the drum. The above variation is imparted to the cartridge as fine vibration, causing the drum to generate fine vibration within the apparatus body. As a result, the drum and an optical writing device disposed in the apparatus body are displaced relative to each other. Such displacement is no better than the irregular rotation of the drum and renders an image irregular.

SUMMARY OF THE INVENTION

It is therefore an object of the present invention to provide an image forming cartridge for an image forming apparatus capable of obviating irregular images.

An image forming cartridge removably mounted on an image forming apparatus of the present invention includes an image carrier for electrostatically forming a latent image thereon by electrophotography. A plurality of image forming members execute image formation with the image carrier. A casing accommodates the image carrier and image forming members. The image carrier has at least one axial end thereof supported such that it does not interfere with the casing. When the cartridge is mounted to the body of the image forming apparatus, a support portion for the image carrier and the casing are mounted to the body independently of each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
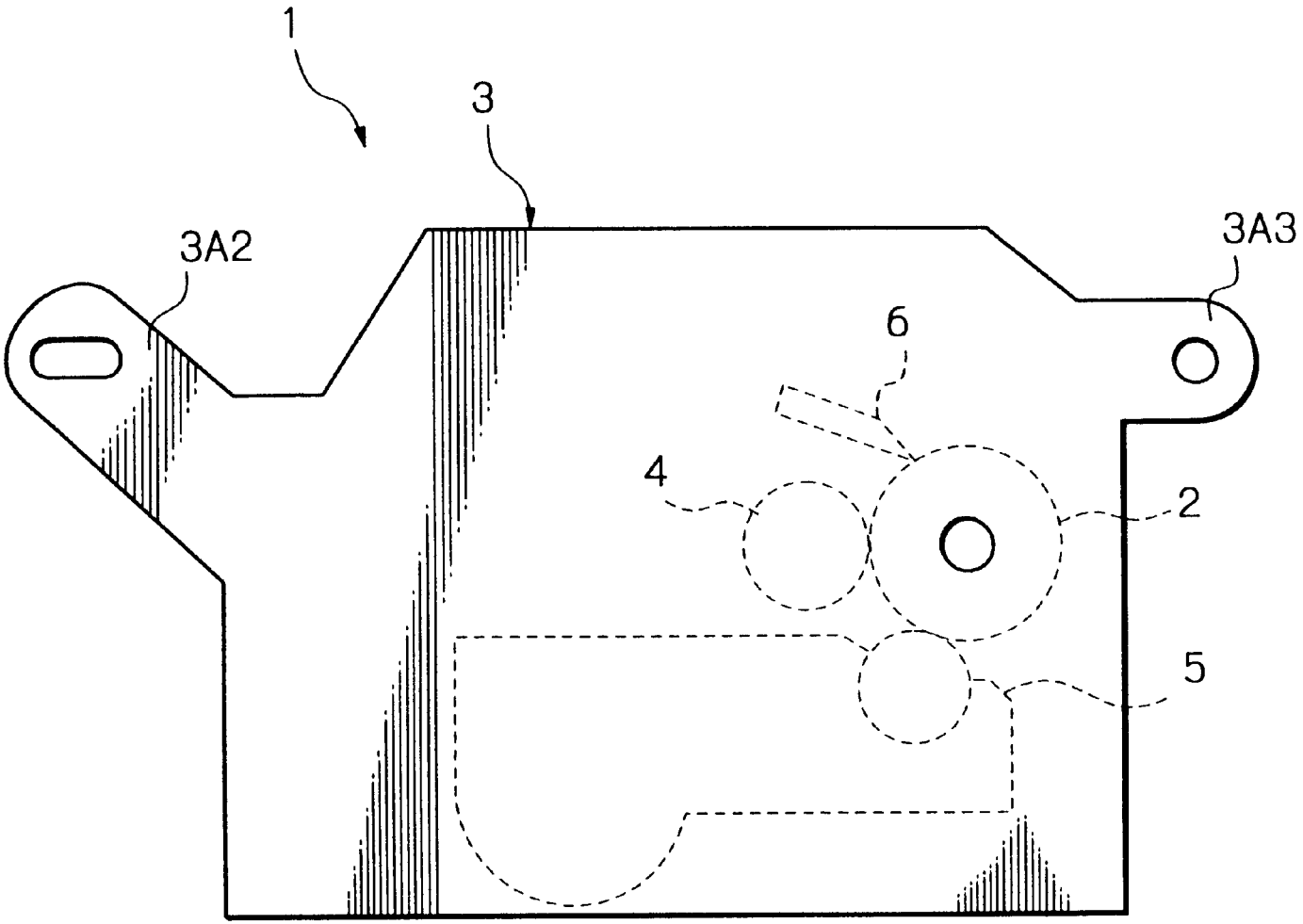
FIG. 1 is a side elevation showing a cartridge embodying the present invention.

Referring to FIG. 1 of the drawings, an image forming cartridge embodying the present invention is shown. As for drive transmission, the illustrative embodiment uses, among the two systems stated earlier, the second system in which a drive force is transmitted from the body of an image forming apparatus to each of various image forming devices arranged in the cartridge along a respective path.

As shown in FIG. 1, the image forming cartridge, generally 1, includes a casing 3 accommodating a photoconductive drum 2 which is a specific form of an image carrier. The casing 3 is so configured as to cover the drum 2 in the axial direction and the top of the drum 2. A charger 4, a developing unit 5 and a cleaning unit 6 which are other members or devices for executing an electrophotographic image forming process are also arranged in the casing 3.

In the illustrative embodiment, the charger 4 is implemented by a roller contacting the drum 2 and uniformly charges the drum 2. The developing unit 5 develops a latent image electrostatically formed on the drum 2 with toner. The cleaning unit 6 removes toner remaining on the drum 2 after development. In the illustrative embodiment, the cleaning unit 6 includes a cleaning blade contacting the drum 2.

Figure 2:
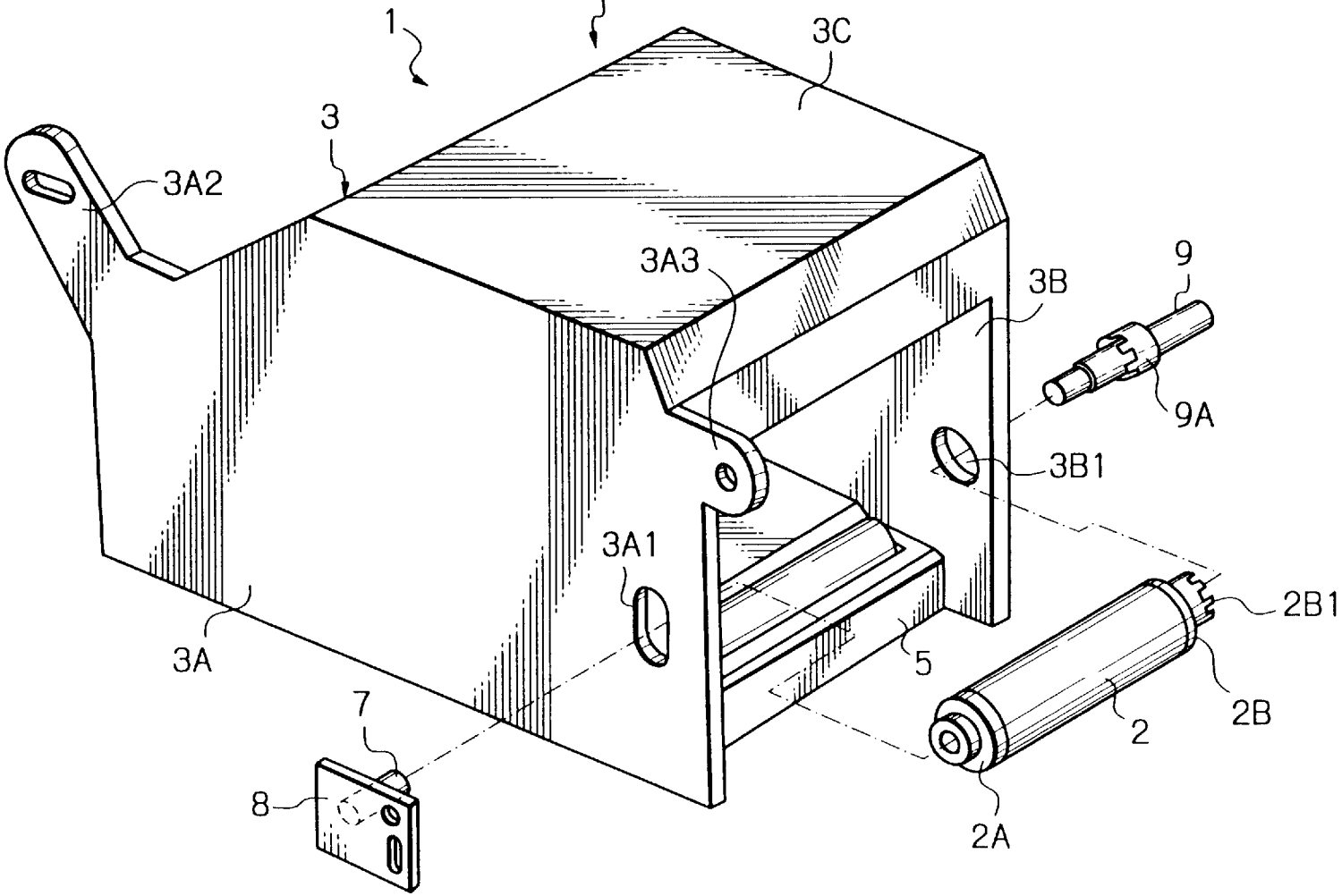
FIG. 2 is an external perspective view showing the cartridge of FIG. 1.

As shown in FIG. 2, the casing 3 forming a major part of the cartridge 1 is open at its side to which a paper is conveyed from the body of an image forming apparatus not shown. The side of the casing 3 facing the above open side is also open for driving the paper out of the casing 3. The casing 3 has side walls 3A and 3B at opposite sides of the open sides and a top wall 3C connecting the upper ends of the side walls 3A and 3B.

The charger 4, developing unit 5 and cleaning unit 6 disposed in the casing 3 are supported by support portions, not shown, and driven by the apparatus body.

Holes 3A1 and 3B1 are respectively formed in the side walls 3A and 3B of the casing 3. The axially opposite ends of the drum 2 are received in the holes 3A1 and 3B1. A drum shaft 7 is affixed to a plate 8 capable of being mounted to the apparatus body. The drum shaft 7 is inserted in one end of the drum 2. A drum drive shaft 9 rotatably supported by the apparatus body is inserted in the other end of the drum 2.

More specifically, the drum 2 has end plates 2A and 2B at its opposite ends outside of the range of a photoconductive layer. The drum shaft 7 and drum drive shaft 9 can be is inserted into the end plates 2A and 2B, respectively. The end plate 2B for receiving the drum drive shaft 9 includes an engaging member 2B1 while the drum drive shaft 9 includes an engaging member 9A forming a part of a drive transmission member. The engaging members 2B1 and 9A each are formed with projections and recesses alternating in the circumferential direction. The engaging members 2B1 and 9A are capable of mating with each other for setting up drive transmission to the drum 2.

Figure 4A:
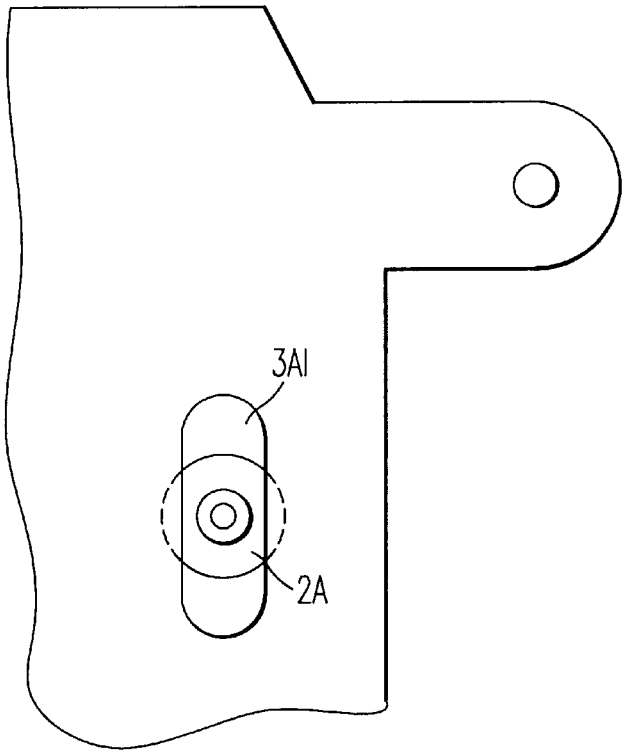
FIGS. 4*a* and 4*b* are external cut away views showing the floating state of the end plates with respect to the casing.
Figure 4B:
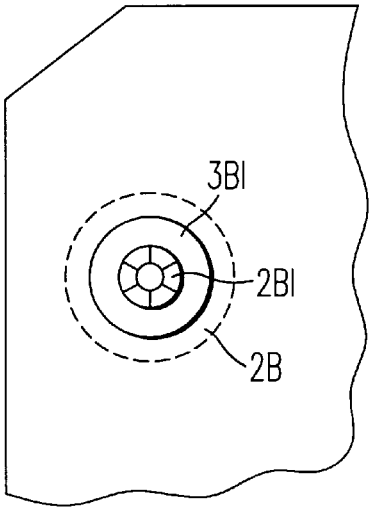

The holes 3A1 and 3B1 in which the drum 2 is inserted prevent the drum 2 and casing 3 from interfering with each other. Specifically, the holes 3A1 and 3B1 are sized slightly greater than the end plates 2A and 2B of the drum 2, so that the end plates 2A and 2B are supported in a floating state relative to the casing 3 as shown in FIGS. 4*a* and 4*b*. In this condition, the vibration of the casing 3 is not transferred to the drum 2.

Figure 3:
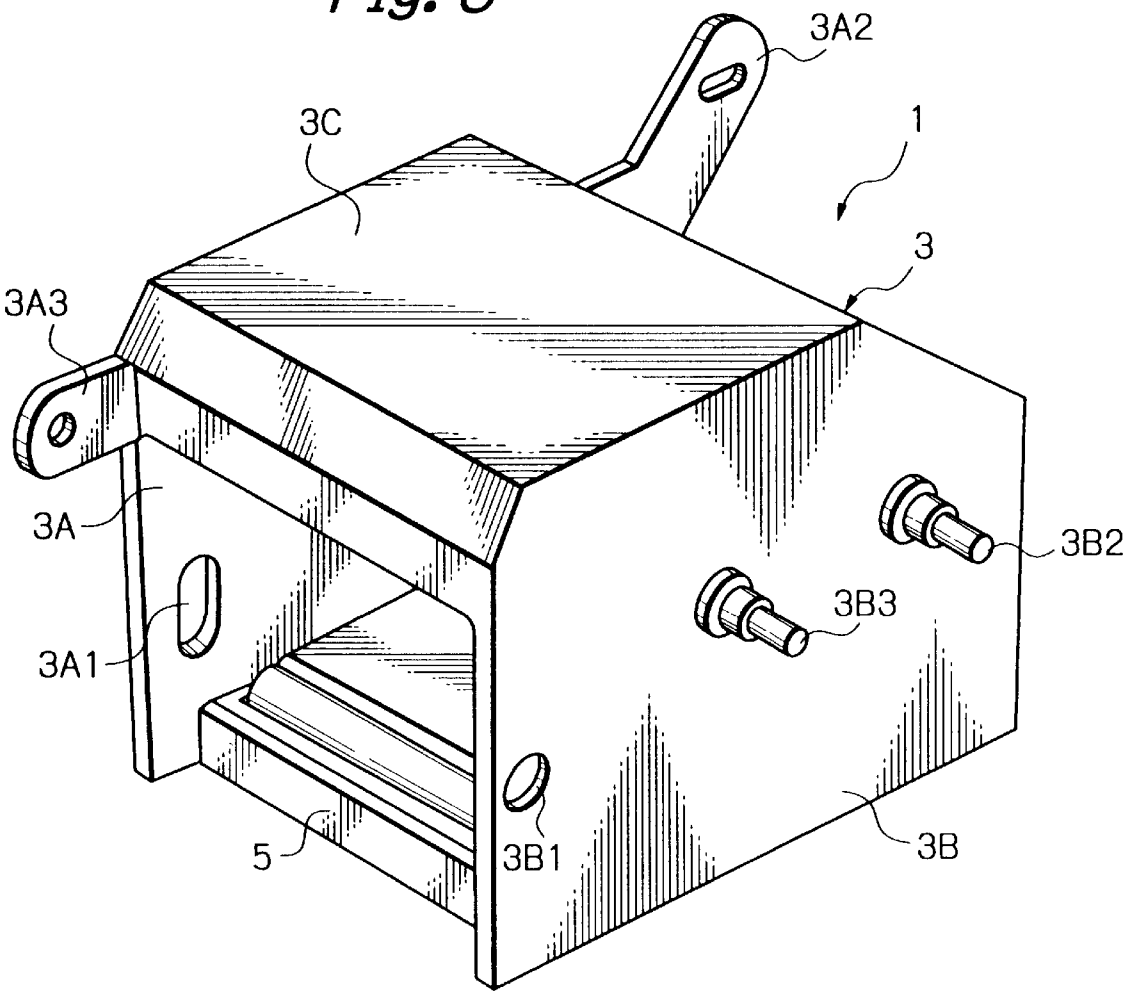
FIG. 3 is a perspective view showing the cartridge of FIG. 1 as seen in another direction.

To allow the casing 3 to be mounted to the apparatus body, a plurality of ribs 3A2 and 3A3 each having a hole protrude from one side wall 3A of the casing 3. In addition, as shown in FIG. 3, a plurality of support pins 3B2 and 3B3 protrude from the other side wall 3B for the above purpose.

To assemble the cartridge 1, the charger 4, developing unit 5 and cleaning unit 6 are mounted to the casing 3. Then, the end plates 2A and 2B of the drum 2 are respectively inserted into the holes 3A1 and 3B1 of the casing 3. As a result, the cartridge 1 accommodating the drum 2 and some devices for executing the image forming process with the drum 2 is completed.

Subsequently, the cartridge 1 is inserted into the apparatus body with the support pins 3B2 and 3B3 of the casing 3 at the head. After the pins 3B2 and 3B3 have been received in support portions, not shown, formed in the apparatus body, the ribs 3A2 and 3A3 are fastened to the apparatus body by bolts not shown. As a result, the cartridge 1 is affixed to the apparatus body. The cartridge 1 may be removed from the apparatus body if the above procedure is effected in the reserve order. In this manner, the cartridge 1 is removably mounted to the apparatus body.

When the cartridge 1 is mounted to the apparatus body, as stated above, the drum drive shaft 9 is inserted in the end plate 2B of the drum 2. At this instant, the engaging member 9A of the shaft 9 and the engaging member 2B1 of the end plate 2B are brought into mesh with each other, setting up a drive transmission path from the apparatus body to the cartridge 1.

The plate 8 has its drum shaft 7 inserted in the end plate 2A of the drum 2 and is then mounted to the apparatus body. Consequently, the drum 2 is positioned relative to the apparatus body by the drum shaft 7 and drum drive shaft 9 and prevented from interfering with the casing 3. The drum 2 is therefore adequately positioned relative to an optical writing device, not shown, arranged in the apparatus body. This frees the drum 2 from the influence of, e.g., irregular rotation and insures stable optical writing.

When a drive force is transmitted from the apparatus body to the drum 2 and various units mounted on the cartridge 1, it is likely that vibration occurring at drive transmission paths extending to the units is imparted to the casing 3. However, the vibration is not imparted to the drum 2 via the casing 3 because the casing 3 and drum 2 do not interfere with each other.

More specifically, although drive loads may vary at drive transmission positions between the apparatus body and the image forming members other than the drum 2, the variation is prevented from being transferred to the members supporting the cartridge 1 as fine vibration. It follows that the drum 2 and the optical writing device of the apparatus body are prevented from being displaced relative to each other. This successfully obviates irregular image density without regard to the density of an image formed on the drum 2, particularly even when the density of the image is low.

With the above configuration, it is possible to increase the drive force meant for, e.g., the developing unit 5 driven with a heavy load without taking account of the influence of the drive force on the drum 2. Therefore, when a speed reduction mechanism or similar mechanism is additionally mounted on the cartridge 1, the resulting vibration to be imparted to the casing 3 is reduced.

In the above embodiment, the end plates 2A and 2B mounted on the opposite ends of the drum 2 are supported such that they do not interfere with the casing 3. Alternatively, only one end of the drum 2 may be supported in such a manner as not to interfere with the casing 3. In such an alternative case, a shock absorbing material or similar vibration reducing member should preferably be positioned between the end of the drum 2 supported by the casing 3 and the casing 3.

In summary, in accordance with the present invention, an image carrier is supported by a casing without interfering with the casing. A cartridge with such a casing and the image carrier are mounted to the body of an image forming apparatus independently of each other. This prevents the vibration of the cartridge from being imparted to the image carrier. The vibration would render the rotation of the image carrier irregular and would thereby bring about banding in a low density image. The cartridge is therefore capable of reproducing an image in a desirable manner.

Further, the image carrier in the form of a photoconductive drum is supported and positioned by support portions affixed to the apparatus body. The image carrier is therefore positioned relative to an optical writing section disposed in the apparatus body more adequately than when it is mounted in the cartridge and positioned there inside. This insures stable optical writing free from the influence of, e.g., irregular rotation and obviates irregular images more positively.

Various modifications will become possible for those skilled in the art after receiving the teachings of the present disclosure without departing from the scope thereof.

What is claimed is:

1. An image forming cartridge removably supported by an image forming apparatus, comprising:

an image carrier configured to have a latent image formed thereon by electrophotography;

a plurality of image forming members configured to execute image formation with said image carrier; and a casing accommodating said image carrier and said plurality of image forming members;

said image carrier having at least one axial end thereof supported such that said at least one end does not interact with said casing;

wherein when said image forming cartridge is mounted to a body of said image forming apparatus, a first support portion for said image carrier and a second support portion for said casing are mounted to said body independently of each other.

2. An image forming cartridge as claimed in claim 1, wherein said image carrier comprises a photoconductive drum and said first support portion comprises a drum shaft affixed to said body and configured to be inserted in one of said at least one axial end of said photoconductive drum that does not interact with said casing.

3. An image forming cartridge as claimed in claim 1, wherein one axial end of said image carrier is mounted to said casing via a shock absorbing mounting device.

4. An image forming cartridge as claimed in claim 1, wherein each axial end of said image carrier is supported such that it does not interact with said casing.

5. An image forming apparatus as claimed in claim 4 wherein said casing comprises two opposing sidewalls connected to a top wall such that the casing has opposing first and forming cartridge to said body.

6. An image forming cartridge as claimed in claim 5, wherein said opposing side walls of said casing each has a hole formed therein, said holes being substantially aligned with one another and configured to receive opposing axial ends of said image carrier.

7. An image forming cartridge as claimed in claim 6, wherein each of said holes is larger than a respective axial end.

8. An image forming cartridge as claimed in claim 7, wherein said first support portion comprises:

a drum shaft affixed to said body and configured to be inserted in a first of said axial ends of said image carrier such that said first axial end is not in contact with a periphery of a respective hole in said sidewalls; and a drum drive shaft rotatably supported by said body and configured to mate with the other axial end of said image carrier such that said other axial end is not in contact with another periphery of another respective hole in said sidewalls.

9. An image forming cartridge as claimed in claim 7, wherein said second support portion comprises:

a plurality of ribs protruding from one opposing sidewall of said casing and configured to be mounted to a main body portion; and a plurality of pins extending from said other sidewall, each pin configured to engage a corresponding support portion of the main body.

10. A method of producing an image forming apparatus having a main body, an image forming cartridge which has a casing that contains at least an image carrier, and a drive transmission, said method comprising:

mounting said casing of said image forming cartridge to an interior of said main body; and rotatably securing said image carrier to said main body such that said image carrier does not interact with said casing of said image forming apparatus thereby reducing the transfer of vibrations, induced in said casing by said drive transmission, to said image carrier.

11. An image forming apparatus comprising:

a main body;

an image forming cartridge which includes an image carrier, a plurality of image forming members, and a casing accommodating said image carrier and said plurality of image forming members;

a transmission system mounted within said main body and configured to drive said image carrier and said plurality of image forming members;

means for removably mounting said image forming cartridge in said main body of said image forming apparatus;

means for rotatably securing said image carrier to said main body independently of said means for removably mounting the image forming cartridge, wherein vibrations induced in said casing by said transmission system are isolated from said image carrier thereby improving the quality of the image produced by said image forming apparatus.

* * * * *